US007455636B2

(12) United States Patent
Leighton

(10) Patent No.: US 7,455,636 B2
(45) Date of Patent: Nov. 25, 2008

(54) APPLICATION OF ZIPPERS TO FILM MATERIAL

(75) Inventor: Murray Edward Bruce Leighton, Whitley Bay (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/586,903

(22) PCT Filed: Jan. 21, 2005

(86) PCT No.: PCT/GB2005/000216

§ 371 (c)(1),
(2), (4) Date: May 25, 2007

(87) PCT Pub. No.: WO2005/070661

PCT Pub. Date: Aug. 4, 2005

(65) Prior Publication Data

US 2007/0283664 A1 Dec. 13, 2007

(30) Foreign Application Priority Data

Jan. 23, 2004 (GB) ..... 0401500.4

(51) Int. Cl.
*B31B 19/90* (2006.01)
*B65B 61/18* (2006.01)

(52) U.S. Cl. ..... 493/213; 53/412; 53/133.4; 53/139.2; 156/66

(58) Field of Classification Search ..... 53/133.4, 53/139.2, 412; 493/213; 156/66
See application file for complete search history.

(56) References Cited

U.S. PATENT DOCUMENTS

| | | | | |
|---|---|---|---|---|
| 3,692,608 | A | 9/1972 | Risgaard | |
| 4,617,683 | A * | 10/1986 | Christoff | 383/63 |
| 4,655,862 | A | 4/1987 | Christoff et al. | |
| 4,878,987 | A * | 11/1989 | Ven Erden | 156/519 |
| 4,979,933 | A * | 12/1990 | Runge | 493/215 |
| 5,937,615 | A | 8/1999 | Forman | |
| 6,044,621 | A * | 4/2000 | Malin et al. | 53/412 |

(Continued)

FOREIGN PATENT DOCUMENTS

DE 12 15 571 B 4/1966

(Continued)

*Primary Examiner*—Stephen F Gerrity
(74) *Attorney, Agent, or Firm*—Day Pitney LLP

(57) ABSTRACT

An apparatus for application of zippers to film material 10 comprises an applicator bar 22 for presenting pre-cut lengths of zipper 26 to the film and a heated sealing bar 34 for sealing the pre-cut lengths to the film. The applicator bar, the sealing bar, feed rollers 30*a*, 30*b* and a zipper cutter 32 are mounted for movement with the film on a linear motor 14. A pneumatic cylinder 18 raised the application bar towards the film 10. The applicator bar moves in direction C to apply the zipper to the film 10 moving in direction A, then moves with the sealing bar and the film in direction B, away from the film in direction C', back to its starting position in direction B', then towards the film again in direction C. A further length of zipper may be fed to the applicator bar at any time after the bar has moved away from the film in direction C' and therefore during an end portion of the forward stroke of the motor, or during its return stroke.

11 Claims, 4 Drawing Sheets

U.S. PATENT DOCUMENTS

| | | | | |
|---|---|---|---|---|
| 6,350,340 | B1 * | 2/2002 | Johnson | 156/252 |
| 6,553,740 | B2 * | 4/2003 | Delisle | 53/133.4 |
| 6,568,150 | B2 * | 5/2003 | Forman | 53/133.4 |
| 6,574,939 | B1 | 6/2003 | Heijnen et al. | |
| 6,751,932 | B1 * | 6/2004 | Matthews | 53/412 |
| 6,792,740 | B2 * | 9/2004 | Buchman | 53/412 |
| 6,863,754 | B2 * | 3/2005 | Wright et al. | 156/64 |

FOREIGN PATENT DOCUMENTS

| | | | |
|---|---|---|---|
| DE | 1215571 | | 4/1966 |
| DE | 37 15 146 | A1 | 12/1988 |
| DE | 3715146 | | 12/1988 |
| DE | 198 29 111 | A1 | 3/2000 |
| DE | 19829111 | | 3/2000 |
| EP | 0879767 | | 11/1998 |
| GB | 2355687 | | 5/2001 |
| WO | WO 03/097341 | | 11/2003 |
| WO | WO 03/097341 | A | 11/2003 |

* cited by examiner

APPLICATION OF ZIPPERS TO FILM MATERIAL

This invention relates to methods of and apparatus for applying reclosable fastener profiles, otherwise known as zippers, to film material, where the zipper is applied transversely to the direction of movement of the film material.

Transverse web or cross-web technology is now well known, where a zipper is applied transversely to the longitudinal axis of a film, but by its very nature the inclusion of means to stop the film and apply the zipper makes a continuously operating unit inefficient.

It is therefore an object of the present invention to provide a method of and apparatus for applying the zipper while the film material or web is still moving at the normal line rate, thus maintaining the efficiency of the line operation.

Our international patent application WO-A-03/097341 describes and claims such an apparatus and method. The object of the present application is to provide further such apparatus and method.

WO-A-99/59872 (Robert Bosch GmbH) discloses an apparatus for applying zippers transversely to a moving web of film material. The apparatus includes a fixed guide cassette to which lengths of zipper are fed for application to the web by a securing device which includes a pair of sealing jaws which are movable back and forth in the direction of web movement.

According to the present invention there is provided an apparatus for applying a zipper strip to a moving film transversely to the direction of movement of the film, comprising means for producing continuous movement of the film in the said direction, applicator means arranged to receive the zipper strip, to present it to the film at a first location and to move with the film in the said direction to a second location, and sealing means arranged to move together with the applicator means in the said direction from the first to the second location to effect sealing of the zipper strip the film during the said movement, the applicator means and the sealing means being arranged for reciprocal return movement in a direction opposite to the said direction from the second location to the first location.

Preferably, the apparatus includes a zipper-supply means arranged to supply lengths of zipper strip to the applicator means, the applicator means, the zipper-supply means and the sealing means being arranged for movement as a unit between the first and second locations.

Advantageously, the zipper-supply means comprises means for cutting continuous zipper into lengths for application to the film and means for feeding the continuous zipper to the cutting means.

Conveniently, the apparatus includes means for receiving a continuous zipper supply, the supply-receiving means being stationary relative to the zipper-supply means.

Preferably, the applicator means and the sealing means are located at respective opposite sides of the film.

Conveniently, the sealing means comprises a heated sealing bar.

Advantageously, the applicator means and the sealing means are reciprocally driven by a linear motor.

Preferably, the applicator means is movable towards and away from the film in a direction substantially perpendicular to the said direction.

The invention also provides a method of applying a zipper strip to a moving film transversely to the direction of movement of the film, the method comprising moving the film continuously in said direction, supplying a zipper strip to the film at a first location by an applicator means, moving the applicator means and sealing means together with each other in the said direction from the first to the second location to effect sealing of the zipper strip to the film during the movement from the first to the second location, and returning the applicator means and sealing means in a direction opposite to the said direction from the second to the first location.

Preferably, the lengths of zipper strip are supplied to the applicator means from a zipper-supply means, the zipper-supply means being moved as a unit with the applicator means and the sealing means between the first and second locations.

A further zipper strip length may be supplied from the zipper-supply means to the applicator means no later than the return of the applicator means, zipper-supply means and sealing means to the first location.

Advantageously, further zipper strip length is supplied to the applicator means after sealing of the first zipper strip length to the film but prior to arrival of the applicator means, zipper-supply means and sealing means at the second location.

Preferably, the further zipper strip length is supplied to the applicator means during the return movement of the applicator means, zipper-supply means and sealing means to the first location.

Preferably, the applicator means is moved at the first location in a direction substantially perpendicular to the said direction of movement of the film, in order to apply the zipper to the film and is moved in the opposite direction after sealing of the zipper strip to the file and prior to its return movement to the first location.

An embodiment of the invention will now be described by way of example with reference to the drawings of this specification, in which.

Figure 1:
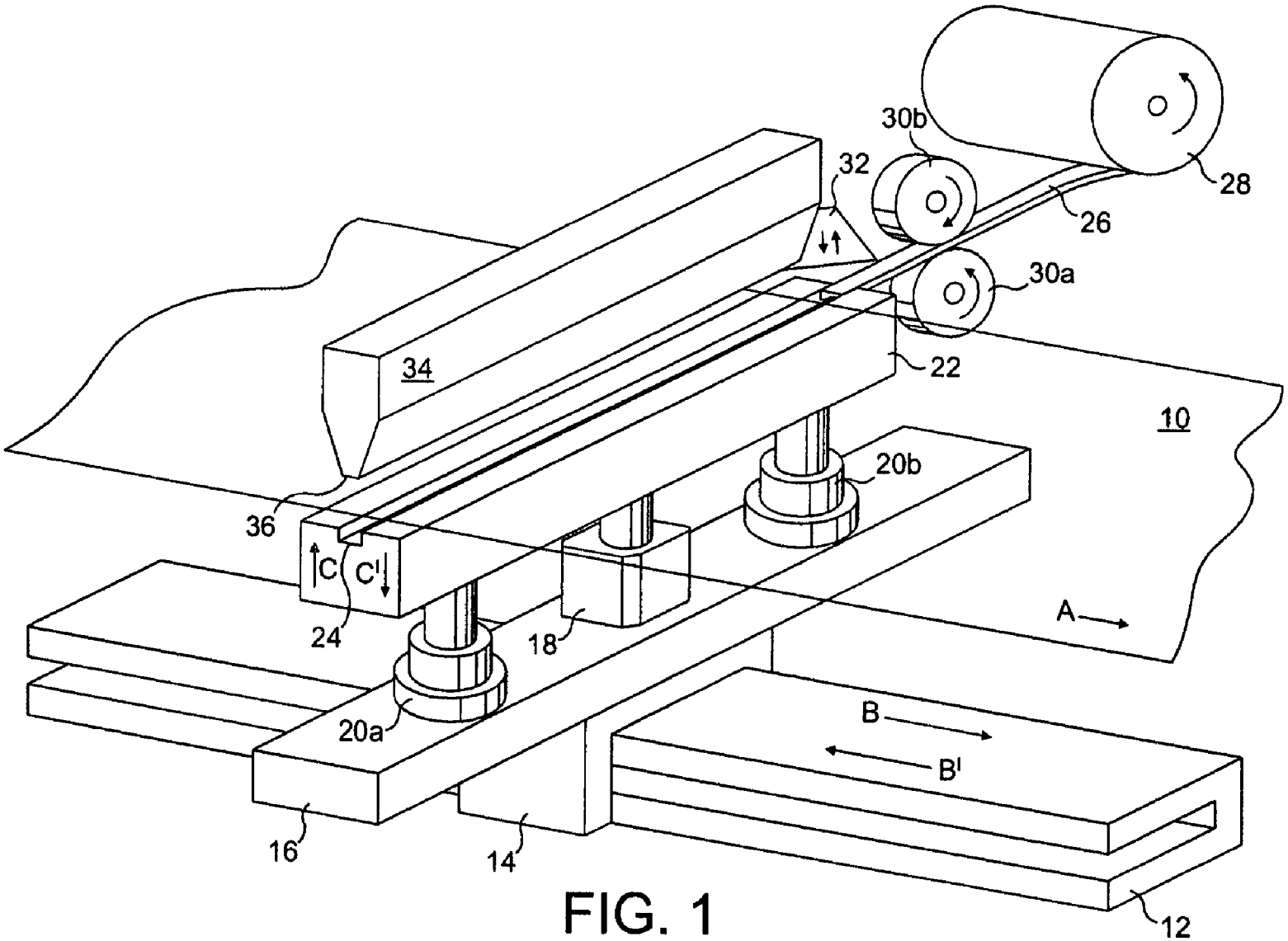
FIG. 1 is a somewhat schematic perspective view of an apparatus for applying zipper strips transversely to a moving web.

FIG. 1 shows a web of plastics film 10 which is moving continuously in the direction A shown by an arrow. A guideway 12 for a linear motor 14 is mounted beneath the film 10. The linear motor can be driven to move linearly in first and second, opposite directions B,B' shown by arrows. The linear motor 14 may be of any of the many known types of linear motor which are well-known to one skilled in the art of the present invention. The linear motor 14 is provided with suitable power and control means which are also well-known to one skilled in the art and are therefore not shown in FIG. 1 or described further herein.

A support platform 16 is mounted on the motor 14 and carries centrally a pneumatic cylinder 18, to which compressed air can be supplied by suitable pressure and control means which are well-known in the art and are, again not shown in FIG. 1 or described further herein. To each side of the cylinder 18, the platform carries a guide 20*a*, 20*b*, each of which consists of a piston-and-cylinder arrangement.

The cylinder 18 and guides 20*a*, 20*b* carry at their upper ends a zipper applicator bar 22. The applicator bar 22 is movable below the film 10 in first and second, opposite directions C,C' shown by arrows, the directions being perpendicular to the direction A of movement of the film 10. The applicator bar 22 has a longitudinal groove 24 which is shaped and dimensioned to receive lengths of zipper 26 which is fed continuously from a spool 28 which is mounted at a suitable stationary location nearby. The continuous length of zipper 26 passes through the nip of a pair of counter-rotating drive rollers 30*a*, 30*b* which are mounted on support platform 16. The drive rollers 30*a*, 30*b* are driven by a suitable drive means (not shown) and feed the zipper 26 beneath a reciprocating blade 32 which is mounted on the applicator bar 22 and is driven and controlled by means (not shown) to cut the zipper 26 into predetermined lengths, usually less than the width of the film 10, the continuous length of zipper 26 being fed into the slot 24 in the applicator bar 22 by the drive rollers 30*a*, 30*b* prior to cutting by the blade 32. The zipper 26 consists of continuous lengths of interengaging releasable male and female fastener strips, for example of any of many known types.

A heated sealing bar 34 is positioned above the film 10 and is fixed relative to the platform 16. The sealing bar 34 is shaped along its lower edge 36 to align with the upper edge of the applicator bar 22 adjacent to the groove 24 in the applicator bar and thereby to apply heat to the film 10 at a location adjacent the location of a length of zipper 26 located in the groove 24 of the applicator bar 22 and presented to the film 10 by upward movement of the applicator bar 22.

Figure 2:
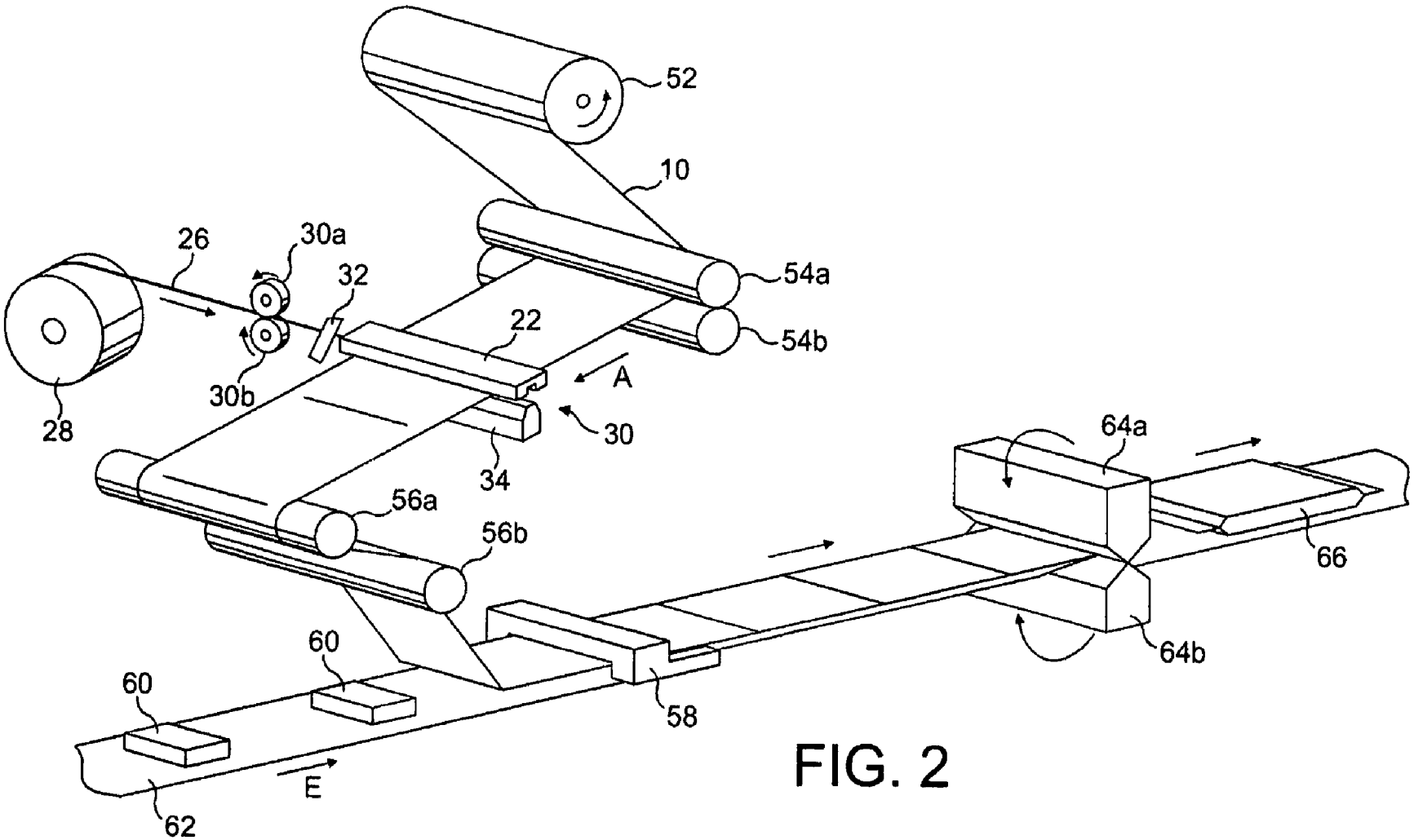
FIG. 2 is a somewhat schematic perspective view of a horizontally-operating form-fill-seal packaging machine incorporating the apparatus of FIG. 1.

FIG. 2 of the drawings shows the general arrangement of a horizontally-operating form-fill-seal packaging machine which includes the apparatus of FIG. 1 which is indicated by the reference numeral 50. The apparatus 50 is orientated with the applicator bar 22 uppermost in FIG. 2: any orientation is possible. In the orientation of FIG. 2, a suitable vacuum device (not shown) is included to retain zipper lengths in the groove 24.

It should be noted that, although the invention is described herein with reference to a horizontally-operating form-fill-seal machine, the invention is equally applicable to vertically-operating form-fill-seal machines (as are also well-known in the packaging art), to machines of the kind known as bag-converting machines which produce empty reclosable bags, and to machines (known as reel-to-reel machines) which apply lengths of zipper to a continuous film for subsequent use in form-fill-seal of bag-converting machines.

Returning now to FIG. 2, the film 10 is stored in a roll 52 which can rotate to allow the film to be drawn by a pair of feed rollers 54*a*, 54*b* through the apparatus 50, whence it passes around further guide rollers 56*a*, 56*b* before being fed to a forming box 58 of a conventional horizontal form-fill-seal packaging machine. Articles 60 to be packaged are fed in the direction E shown by an arrow on a conveyor belt 62 to the forming box 58, where, in the conventional manner, the film 10 is folded around the article 60 and the longitudinal edges of the film 10 are brought together and sealed to each other to form a back seal. Subsequently to this, and at a location downstream of the forming box 58, the folded film passes between a pair of heated cross-seal jaws 64*a*, 64*b* which form transverse seals between the inner faces of the folded film and also sever the film to provide individual sealed packages 64 containing the articles 60.

It should be mentioned that, in accordance with cross-web technology, the zipper 26 is cut into lengths which are slightly less than one-half of the width of the film 10, the male and female profiles of the zipper lengths being engaged with each other. The lengths of zipper are located by the applicator bar 22 centrally of the film 12. Thus, when the film is folded in the forming box 58, the portions of the film to each side of the zipper length form the sides and one face of the eventual package. The length of zipper is attached to what becomes the other face of the package, so that, by the operation of the cross-seal jaws, heat is applied to the first face of the package to seal the zipper strip to that face and, after that, the film is severed into individual packages. The packages thus have a transverse heat seal at each end and, positioned inwardly of one of the seals, an openable and reclosable seal formed by the zipper strips for use after opening of the package by breaking the adjacent heat seal.

Figure 3:
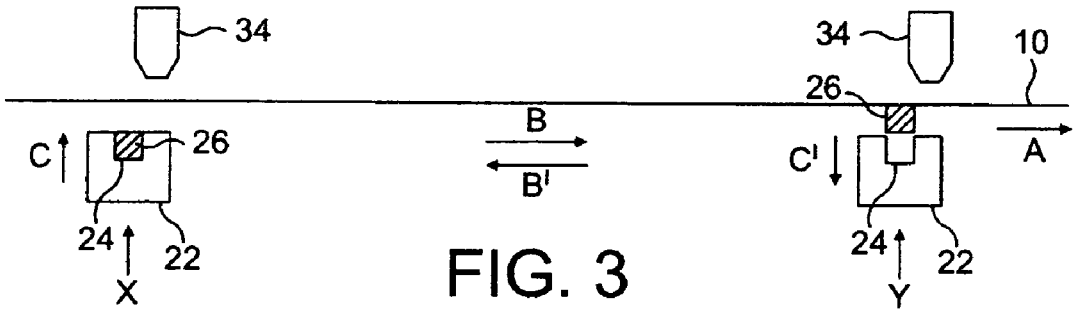
FIG. 3 is a schematic side view showing the operation of the apparatus of FIG. 1.

FIG. 3 of the drawings shows the operation of apparatus of FIG. 1. In FIG. 3, the film 10 is shown moving in the direction A. The applicator bar 22 is shown movable between its first and second limit positions X, Y, determined by the linear motor 12. Movement from X to Y is referred to herein on the "forward stroke"; movement in the reverse direction is referred to on the "return stroke".

The lengths of zipper 26 are presented to the applicator bar 22 when it is in its first limit position X. The bar is then raised by the pneumatic cylinder 18 in the direction C until it contacts the lower surface of the film 12. Further movement in the direction C results in movement of the film 10 against the sealing bar to apply sealing heat to the opposite face of the film 12, the lower edge of the sealing bar coming to rest on the upper (as shown in FIG. 1) edge of the applicator bar 22 adjacent the groove 24.

The applicator bar 22 and seal bar 32 are then moved in the direction B by the linear motor, until the second limit position Y is reached. During this movement, the speed of travel of the motor 14 and of the film 10 are equal to each other. At the second limit position Y, the applicator bar 22 is moved away from the film 10 in the direction C', leaving the zipper length 26 attached to the film 10, prior to its being returned to the first limit position X by movement in the direction B' by the linear motor 14. The cycle is then repeated to apply the zipper strips at spaced intervals along the length of the film 10. The motor 14 is capable of producing a very rapid acceleration and deceleration of the applicator bar 22 and the sealing bar 34, these taking place during the time taken for the movements in the directions C and C'.

Figure 4:
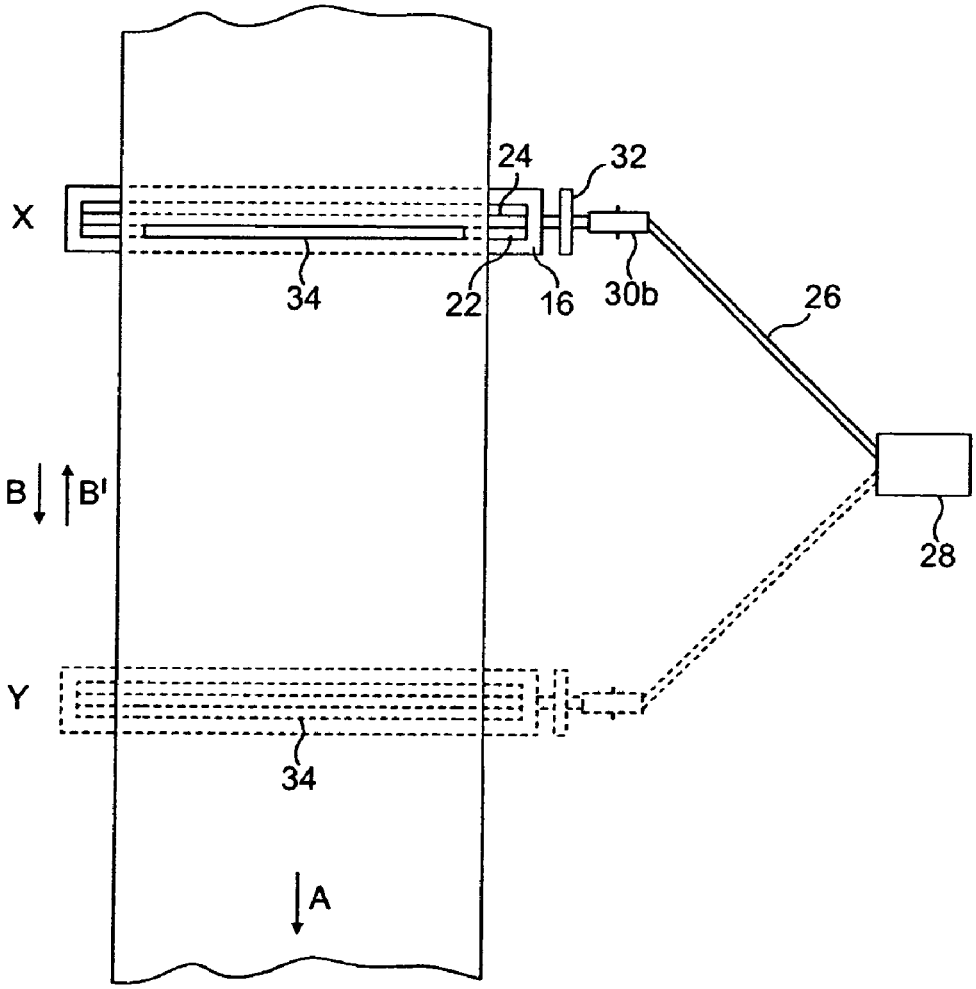
FIG. 4 is a somewhat schematic top plan view of the apparatus of FIG. 1 in operation.

FIG. 4 of the drawings is a schematic plan view corresponding to FIG. 3 and showing the assembly of the support platform 16, applicator bar 22, sealing bar 24, blade 32 and drive rollers 30*a*, 30*b* (all referred to collectively hereinafter as "the applicator unit") moving between the limit positions X and Y. It will be noted that, during this movement, the spool 28 containing the supply of zipper remains stationary whilst the zipper 26 feeding from the spool 18 can swing in an arc with the movement of the linear motor 14.

Although the applicator unit is depicted twice in FIG. 4, it will be appreciated that what is shown is the same unit in two different positions in its cycle of movement, the applicator being shown in dashed lines at position Y.

FIGS. 5*a* to 5*e* of the drawings show the operation of the apparatus of FIG. 4 in more detail. In these figures the film 10 is again shown moving continuously in the direction A. The applicator bar 22 is shown movable between its first and second limit positions X, Y, determined by the linear motor 12.

Figures 5A, 5B, 5C, 5D, 5E:
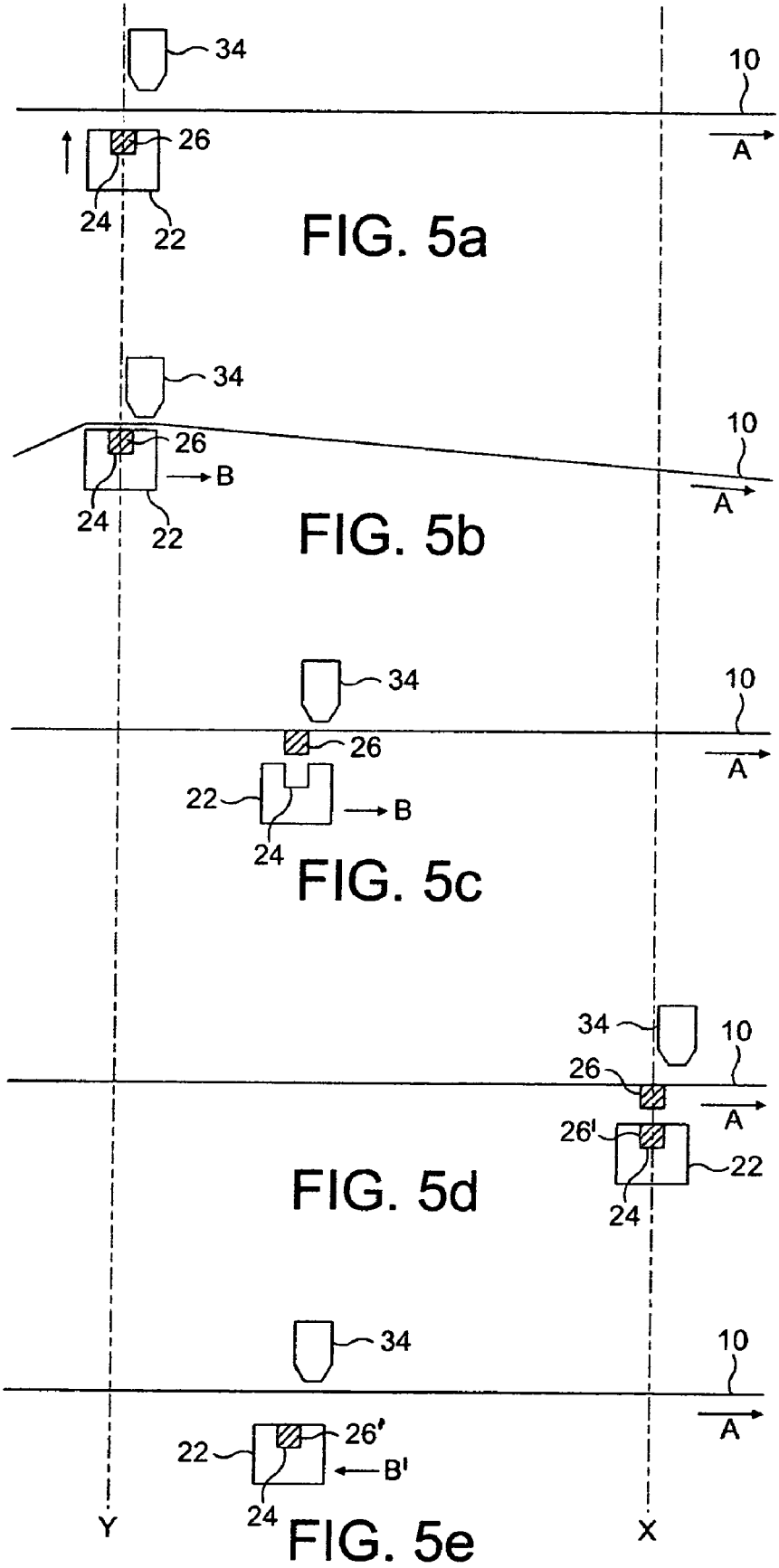
FIGS. 5*a* to 5*e* are further schematic side views showing the operation of the apparatus of FIG. 1.

FIG. 5*a* shows an arbitrary starting point in the cycle in which the applicator bar 22 and the sealing bar 34 are at the first limit position X and with a length of zipper 26 received in the groove in the applicator bar. From this position, the applicator bar 22 is raised by the pneumatic cylinder 18 in the direction C until it contacts the lower surface of the film 12. Further movement in the direction C results in movement of the film 10 against the sealing bar 34 to apply sealing heat and pressure to the opposite face of the film 12, the lower edge 36 of the sealing bar coming to rest on the upper edge of the applicator bar 22 adjacent the groove 24. The condition shown in FIG. 5*b* of the drawings is thereby achieved. The application of heat from the sealing bar 32 to the applicator bar 22 adjacent the groove 24 causes fusion of the zipper strip to the film 10.

In the next phase of the cycle of operation, the applicator unit is moved towards the second limit position Y by the linear motor in the direction B, the motor moving at the same linear speed as the film 10. At a predetermined point in this forward stroke of the application unit, determined to be after the point at which the zipper strip 26 has become attached to the film 10, the pneumatic cylinder 18 is actuated to lower the applicator bar 22 to leave the zipper length 26 adhered to the lower surface of the film 10. The groove in the applicator bar is now empty and ready to receive a further length of zipper supplied by the rollers 30*a*, 30*b*. This condition is shown in FIG. 5*c*. The condition may be reached at any point in the forward stroke of movement of the applicator unit from the first to the second limit position, up to the second limit position itself.

In the next phase of the cycle of operation, a further length of zipper 26 is fed by the drive rollers 30*a*, 30*b* into the groove 24 in the applicator bar 22 and cut to length by the blade 32. This may take place before the applicator unit has reached the second limit position, at the second limit position, or at a later stage in the cycle of operation (see below). The condition achieved when the zipper length has been fed into the groove 24 not later than the second limit position is shown in FIG. 5*d* of the drawings.

At the second limit position X, the applicator unit is brought to a halt by the linear motor 14. At this point in the operational cycle, a further length of zipper 26' may or may not have been fed into the applicator bar groove 24.

The linear motor is now controlled to return in direction B' from the second to the first limit position. If it has not already been done, a further length of zipper 26' is fed into the groove 24 during this return stroke of movement of the applicator unit. FIG. 5*e* shows the situation at an intermediate point on the reverse stroke after feeding of the further zipper length into the applicator bar slot. At the end of the reverse stroke, the condition shown in FIG. 5*a* is again achieved. During the reverse stroke, the cylinder 18 maintains the applicator bar 22 in its lowered position; the speed of movement of the unit is conveniently the same as during the forward stroke but this is not necessarily so.

The invention claimed is:

1. An apparatus for applying a zipper strip to a moving film transversely to the direction of movement of the film, comprising means for producing continuous movement of the film in the said direction, applicator means arranged to receive the zipper strip, to present it to the film at a first location and to move with the film in the said direction to a second location, a zipper-supply means arranged to supply lengths of zipper strip to the applicator means; and sealing means arranged to move together as a unit with the applicator means and zipper-supply means in the said direction from the first to the second location to effect sealing of the zipper strip to the film during the said movement, the applicator means and the sealing means being arranged for reciprocal return movement in a direction opposite to the said direction from the second location to the first location.

2. An apparatus according to claim 1, in which the zipper-supply means comprises means for cutting continuous zipper into lengths for application to the film and means for feeding the continuous zipper to the cutting means.

3. An apparatus according to claim 2, including means for receiving a continuous zipper supply, the supply-receiving means being stationary relative to the zipper-supply means.

4. An apparatus according to claim 1, in which the applicator means and the sealing means are located at respective opposite sides of the film.

5. An apparatus according to claim 1, in which the sealing means comprises a heated sealing bar.

6. An apparatus according to claim 1, in which the applicator means and the sealing means are reciprocally driven by a linear motor.

7. An apparatus according to claim 1, in which the applicator means is movable towards and away from the film in a direction substantially perpendicular to the said direction.

8. A method of applying a zipper strip to a moving film transversely to the direction of movement of the film, the method comprising moving the film continuously in said direction, supplying lengths of zipper strip to an applicator means from a zipper-supply means; supplying a zipper strip to the film at a first location by said applicator means, moving the zipper-supply means, the applicator means and a sealing means together as a unit in said direction from the first to a second location to effect sealing of the zipper strip to the film during the movement from the first to the second location, and returning the applicator means and sealing means in a direction opposite to the said direction from the second to the first location.

9. A method according to claim 8, in which a further zipper strip length is supplied to the applicator means after sealing of the first zipper strip length to the film but prior to arrival of the applicator means, zipper-supply means and sealing means at the second location.

10. A method according to claim 8, in which a further zipper strip length is supplied to the applicator means during the return movement of the applicator means, zipper-supply means and sealing means to the first location.

11. A method according to claim 8, in which the applicator means is moved at the first location in a direction substantially perpendicular to the said direction of movement of the film, in order to apply the zipper to the film and is moved in the opposite direction after sealing of the zipper strip to the file and prior to its return movement to the first location.

* * * * *